US009487368B1

(12) United States Patent
Ikeda

(10) Patent No.: US 9,487,368 B1
(45) Date of Patent: Nov. 8, 2016

(54) IMAGE FORMING APPARATUS WITH ROTATABLE PAPER CONVEYANCE ASSEMBLY

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Wataru Ikeda, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/856,643

(22) Filed: Sep. 17, 2015

(51) Int. Cl.

| | |
|---|---|
| ***G03G 15/00*** | (2006.01) |
| ***B65H 5/26*** | (2006.01) |
| ***B65H 1/04*** | (2006.01) |
| ***B65H 1/26*** | (2006.01) |
| ***B65H 5/02*** | (2006.01) |

(52) U.S. Cl.
CPC *B65H 5/26* (2013.01); *B65H 1/04* (2013.01); *B65H 1/266* (2013.01); *B65H 5/025* (2013.01); *G03G 15/6529* (2013.01); *B65H 2511/13* (2013.01)

(58) Field of Classification Search
CPC ..... G03G 15/6502; G03G 15/6508; G03G 15/6511
USPC ..... 399/388, 391
See application file for complete search history.

(56) References Cited

U.S. PATENT DOCUMENTS

| | | | | |
|---|---|---|---|---|
| 2007/0246879 | A1* | 10/2007 | Sagawa | B65H 3/06 271/12 |
| 2008/0038039 | A1* | 2/2008 | Watase | B41J 11/007 400/642 |
| 2008/0203649 | A1* | 8/2008 | Watase | B65H 3/44 271/9.13 |
| 2008/0211171 | A1* | 9/2008 | Kusumi | B65H 3/44 271/225 |
| 2009/0185846 | A1* | 7/2009 | Okamoto | B65H 5/26 399/388 |

* cited by examiner

*Primary Examiner* — Benjamin Schmitt
*Assistant Examiner* — Matthew Miller
(74) *Attorney, Agent, or Firm* — Amin, Turocy & Watson LLP

(57) ABSTRACT

In accordance with one embodiment, an image forming apparatus is equipped with a conveyance device configured to include a rotatable first pulley and a rotatable second pulley arranged side by side, a belt hung on a first pulley and a second pulley and a conveyance roller connected with the belt on the outer periphery of the first pulley and rotating together with the belt, and sandwich and convey a recording medium at a nip part between the conveyance roller and the belt. The axis of the second pulley of the conveyance device is rotated by the rotating mechanism by taking the axis of the first pulley as a fulcrum.

18 Claims, 6 Drawing Sheets

IMAGE FORMING APPARATUS WITH ROTATABLE PAPER CONVEYANCE ASSEMBLY

FIELD

Embodiments described herein relate generally to an image forming apparatus equipped with a paper feeding device.

BACKGROUND

Conventionally, an image forming apparatus is equipped with a paper feeding device. The paper feeding device conveys a paper stored in a cassette to an image forming section. The cassette is arranged to be multiple according to the paper size and the like. In a recent image forming apparatus, a request that an image is formed on a paper (thick paper) of which the thickness is thick is increasing.

Incidentally, a conveyance path of the paper is not a straight line and a conveyance direction of which may be changed. Therefore, a conveyance speed of the paper is slow at a conversion point of the conveyance direction, which results in a stall of the paper. Specially, the thicker the thickness of the paper is, the higher the possibility of the stall is. Thus, it is necessary to increase a conveyance force of the thick paper. Further, in order to prevent the stall of the paper when the thick paper is conveyed, a plurality of plans such as devising the shape of the conveyance path, reducing the conveyance resistance and the like is proposed.

In order to suppress that the conveyance speed of the paper is slow at the conversion point of the conveyance direction of the paper, it is exemplified to use a conveyance roller and a conveyance belt in the conveyance path. The conveyance belt has a structure hanging on two pulleys. In a case of feeding the paper using the conveyance roller and the conveyance belt, the paper picked up from the cassette is received by the conveyance belt. Then, the direction of the paper is changed towards a nip part between the conveyance roller and the conveyance belt due to the friction force of the belt.

However, if the paper enters at an angle more than 45 degrees with respect to the conveyance belt, the paper is stalled. The worst case is that the paper cannot be conveyed. Further, damages may be applied to the paper. Specifically, when conveying the thick paper, the thick paper cannot be conveyed and a degree of applying the damages to the thick paper is strong.

DETAILED DESCRIPTION

Figure 1:
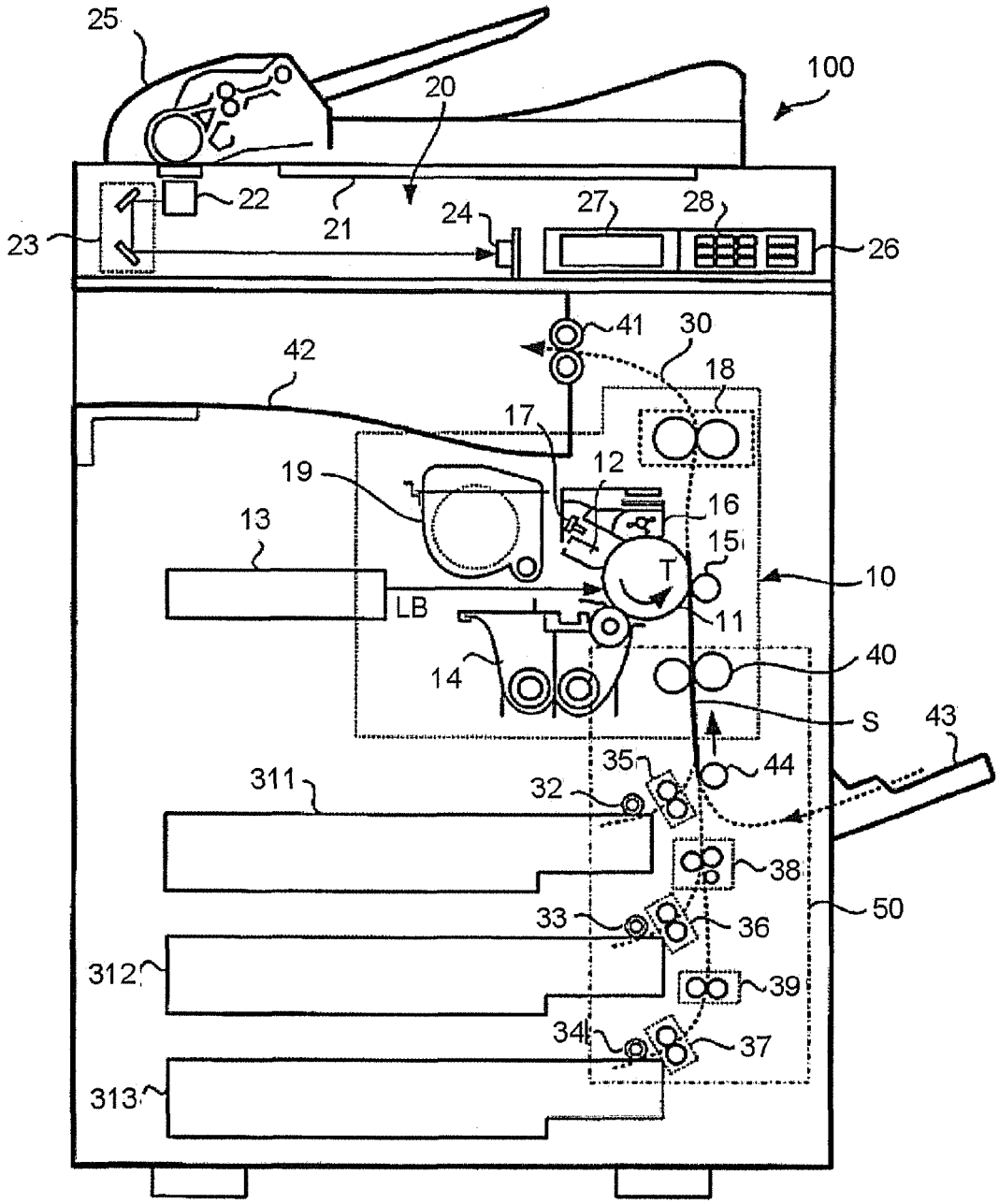
FIG. 1 is a diagram of an image forming apparatus according to an embodiment.

An image forming apparatus according to one embodiment includes a paper feed cassette configured to include a first cassette and a second cassette for storing a recording medium; a conveyance device configured to include a rotatable first pulley and a rotatable second pulley arranged side by side, a belt hung on the first pulley and the second pulley and a conveyance roller connected with the belt on the outer periphery of the first pulley and rotating together with the belt, and sandwich and convey the recording medium at a nip part between the conveyance roller and the belt; a rotating mechanism configured to rotate the axis of the second pulley by taking the axis of the first pulley of the conveyance device as a fulcrum; a control section configured to control the rotating mechanism so as to rotate the axis of the second pulley to a first position, make a recording medium from the first cassette hit the belt of the conveyance device and then guide the recording medium to the nip part, or rotate the axis of the second pulley to a second position and then guide a recording medium from the second cassette from the second pulley side of the conveyance device to the nip part; and an image forming section configured to form an image on the recording medium conveyed by the conveyance device.

Hereinafter, the image forming apparatus according to the embodiment is described in detail with reference to the accompanying drawings. Further, the same components in each figure are applied with the same reference numerals.

First Embodiment

FIG. 1 is a diagram of the image forming apparatus according to an embodiment. In FIG. 1, an image forming apparatus 100 is, for example, an MFP (Multi-Function Peripheral) constituted by an electrophotographic type and the like. In addition to the MFP, the image forming apparatus 100 may be a copier, a printer and the like. In the following description, the MFP is exemplified.

A printer section 10 is arranged at the center of the image forming apparatus (MFP) 100. The printer section 10 is equipped with a rotatable photoconductive drum 11. The photoconductive drum 11 is an image carrier. The photoconductive drum 11 has an organic photo conductor at the outer periphery thereof. The photoconductive drum 11 is irradiated by the light in a state in which the photoconductive drum 11 is charged with a predetermined potential. The potential of an area where the photoconductive drum 11 is irradiated by the light changes, and the photoconductive drum 11 is held at a predetermined time by taking the change of potential as an electrostatic latent image.

Around the photoconductive drum 11, a charging charger 12, an exposure unit 13, a developer 14, a transfer roller 15, a drum cleaner 16 and a charge removing LED 17 are arranged along a rotation direction T of the photoconductive drum 11.

The charging charger 12 charges the surface of the photoconductive drum 11 to a predetermined potential. The exposure unit 13 emits a laser beam LB to the photoconductive drum 11 to expose it. The photoconductive drum 11 forms an electrostatic latent image on the surface thereof through the exposure. The emission intensity of the laser beam LB changes according to the density of the image.

The developer 14 stores a two-component developing agent consisting of a carrier and a toner. The developer 14 supplies the developing agent to the surface of the photoconductive drum 11 and develops the electrostatic latent image on the photoconductive drum 11. The electrostatic latent image on the surface of the photoconductive drum 11 is formed into a visualized toner image. The transfer roller 15 constitutes a transfer device.

The transfer roller 15 applies a predetermined potential to a paper S serving as a recording medium and transfers the toner image on the photoconductive drum 11 to the paper S. The drum cleaner 16 removes a residual toner fixed at the surface of the photoconductive drum 11 to collect it. The charge removing LED 17 removes a residual charge of the photoconductive drum 11.

A fixing device 18 is arranged at the downstream side of the transfer roller 15. The fixing device 18 includes a heat roller and a pressure roller. The paper S is conveyed to a space between the heat roller and the pressure roller. The paper S is heated and pressured at a predetermined temperature and the toner image is fixed on the paper S by the fixing device 18. A toner cartridge 19 storing the toner is arranged at the upside of the developer 14. If the toner in the developer 14 is consumed, the toner is replenished to the developer 14 from the toner cartridge 19.

On the other hand, a scanner section 20 is arranged at the upper portion of the MET 100. The scanner section 20 includes a document placing table 21, a light source 22, a reflecting mirror 23 and an image sensor 24. An ADF (Automatic Document Feeder) 25 is arranged at the upper portion of the document placing table 21 in an openable manner. The light source 22 irradiates a document placed on the document placing table 21 or a document sent to the document placing table 21 from the ADF 25 with the light. The reflecting mirror 23 reflects the light reflected from the document. The image sensor 24 receives the reflected light from the reflecting mirror 23. An operation panel 26 is arranged nearby the scanner section 20. The operation panel 26, which constitutes an operation section, has an operation key 28 and a display section 27 of a touch panel format.

A paper feed cassette is arranged at the lower portion of the MFP 100. The paper feed cassette, which is multiple, includes, for example, three cassettes 311, 312 and 313. The papers serving as the recording mediums are stored in cassettes 311, 312 and 313. Papers of which the sizes are different and the thicknesses are different are stored in a plurality of cassettes 311, 312 and 313. In the following description, it is exemplified that papers (plain papers) of which the thickness is normal are stored in the cassettes 311 and 313 and a paper (thick paper) of which the thickness is thick is stored in the cassette 312.

The recording mediums (papers S) in the cassettes 311, 312 and 313 are picked up by pickup rollers 32, 33 and 34 one by one. The paper S is conveyed from the pickup rollers 32, 33 and 34 to a paper discharge tray 42 (later described) via a conveyance path 30. When the pickup rollers 32, 33 and 34 side is the upstream side, the paper discharge tray 42 side is the downstream side. Paper feed rollers 35, 36 and 37 are respectively arranged at the downstream side of the pickup rollers 32, 33 and 34.

The paper S picked up by the pickup roller 32 of the cassette 311 is conveyed to a resist roller 40 of the further downstream side by the paper feed roller 35. The paper S picked up by the pickup roller 33 of the cassette 312 is conveyed to the resist roller 40 by the paper feed roller 36 and a conveyance device 38. The paper S picked up by the pickup roller 34 of the cassette 313 is conveyed to the resist roller 40 by the paper feed roller 37, a conveyance roller 39 and a conveyance device 38.

The resist roller 40 is rotated at a predetermined timing to align a position of the paper S and a toner image formed on the photoconductive drum 11 and conveys the paper S to a transfer position. The paper S passing through a transfer roller 15 is conveyed to the fixing device 18. The paper S passing through the fixing device 18 is discharged to the paper discharge tray 42 by a paper discharge roller 41.

A manual feeding tray 43 is arranged separately from the paper feed cassette on the MFP 100. The paper S is manually inserted from the tray 43 and guided to the resist roller 40 through a paper feed roller 44. A reversal conveyance path used at the time of carrying out a duplex printing is arranged to be parallel with the conveyance path 30, which is not shown.

In the MFP 100, during the image formation, the document on the document placing table 21 is irradiated by the light from the light source 22. The light reflected by the document enters the image sensor 24 through the reflecting mirror 23. The image sensor 24 reads a document image. Based on the information read by the image sensor 24 or the image information supplied from an external device such as a PC (Personal Computer) and the like, the laser beam LB is output from the exposure unit 13. The surface of the photoconductive drum 11 is irradiated by the laser beam LB. The surface of the photoconductive drum 11 is charged to negative polarity by the charging charger 12. The photoconductive drum 11 is exposed through emitting the laser beam LB from the exposure unit 13 to the photoconductive drum 11. Through the exposure, the electrostatic latent image is formed on the surface of the photoconductive drum 11.

The electrostatic latent image formed on the photoconductive drum 11 absorbs the toner by the developer 14 and is turned into a visualized image (toner image). Then, if the papers S picked up from the cassettes 311, 312 and 313 are conveyed, the toner image on the photoconductive drum 11 is transferred to the paper S by the transfer roller 15. The paper S to which the toner image is transferred is conveyed to the fixing device 18. The paper S is heated and pressured by the fixing device 18, and then the image is fixed on the paper S. The paper S on which the image is fixed is discharged to the paper discharge tray 42 through the paper discharge roller 41.

Figure 2:
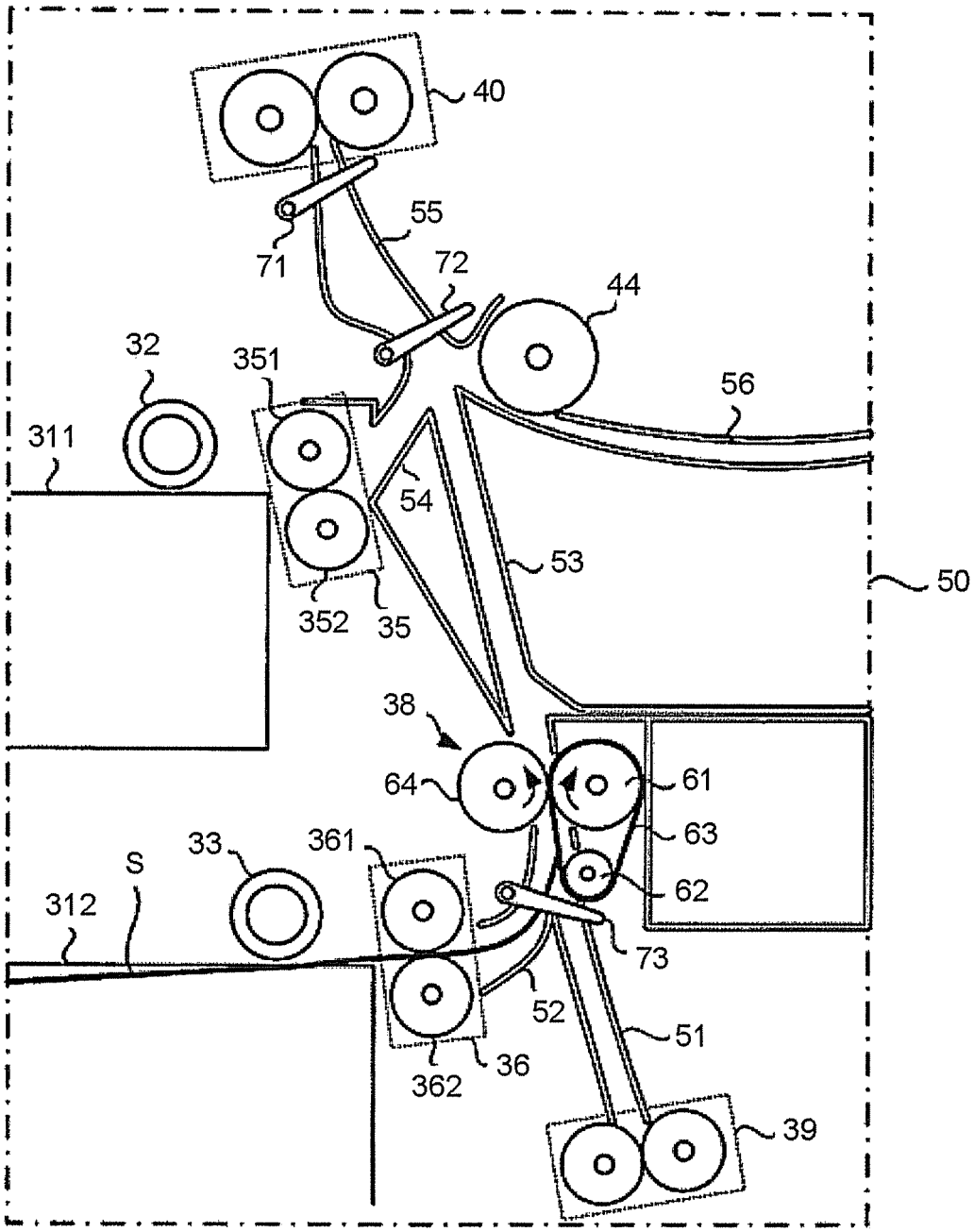
FIG. 2 is a side view illustrating the constitution of a paper feeding device according to the embodiment.

FIG. 2 is a side view illustrating the constitution of a paper feeding device 50 according to the embodiment. The paper feeding device has a plurality of guides 51~55 to guide the papers picked up from the cassettes 311, 312 and 313 to the resist roller 40. Further the paper feeding device 50 has a guide 56 to guide the paper from the manual feeding tray 43 to the paper feed roller 44. A conveyance path of the paper is formed by the guides 51~56. Further, for the sake of convenience, only the cassettes 311 and 312 of upper stage are shown in FIG. 2.

The paper feeding device 50 has pickup rollers 32 and 33 for picking up the papers S from the cassettes 311 and 312. The pickup rollers 32 and 33 are connected with the front end of the uppermost papers S of the cassettes 311 and 312 and rotated to pick up the papers S. The papers S picked up by the pickup rollers 32 and 33 are sent to the paper feed rollers 35 and 36.

The paper feed roller 35 is constituted by a pair of rollers 351 and 352. The rollers 351 and 352 are arranged to face each other. Through the rotation of the rollers 351 and 352, the paper S is conveyed to the downstream side. When the papers more than or equal to 2 sheets are picked up by the pickup roller 32, the roller 352 separates the papers one by one and conveys the separated paper to the downstream side. The roller 352 is also called as a separation roller. The paper S is conveyed to the resist roller 40 along the guides 54 and 55.

The paper feed roller 36, which is similar to the paper feed roller 35, is constituted by a pair of rollers 361 and 362. The roller 362 is also called as a separation roller. Through the rotation of the rollers 361 and 362, the paper S is conveyed to the downstream side. Further, the paper S is conveyed to the resist roller 40 along the guide 52, the conveyance device 38 and the guides 53 and 55.

The paper picked up from the pickup roller 34 of the cassette 313 is conveyed by the paper feed roller 37 and the conveyance roller 39 to the conveyance device 38 along the guide 51.

The conveyance device 38 includes a belt 63 hung between a pair of pulleys 61 and 62 and a conveyance roller 64 arranged to face the pulley 61. The conveyance roller 64 is pressured by a spring 68 (FIG. 4) at the pulley 61 side. If the conveyance roller 64 is rotated in an anticlockwise direction, the belt (pulleys 61 and 62) is driven to rotate in a clockwise direction. Therefore, the paper S is sandwiched at a nip part between the belt 63 and the conveyance roller 64 and conveyed.

The pulleys 61 and 62 are respectively mounted on a first axis and a second axis set at a predetermined distance (details are described later in FIG. 4). The second axis on which the pulley 62 is mounted has such a structure that the second axis is rotated at only a predetermined angle between a first position and a second position by taking the first axis as a fulcrum.

For example, when the paper S from the cassette 312 is conveyed through the paper feed roller 36, the axis of the pulley 62 is rotated at the first position, that is, at the paper feed roller 36 side (left direction of figure). When the paper S from the cassette 313 is conveyed through the conveyance roller 39, the axis of the pulley 62 is rotated at the second position, that is, at the side opposite to the paper feed roller 36 (right direction of figure). The rotation of the axis of the pulley 62 is described in FIG. 5 and FIG. 6.

A plurality of sensors 71, 72 and 73 is arranged on the conveyance path of the paper S formed by the guides 51~55. That is, the sensor 71 is arranged at the upstream side of the resist roller 40, the sensor 72 is arranged at the downstream side of the paper feed roller 44, and the sensor 73 is arranged at the upstream side of the conveyance device 38. The sensors 71, 72 and 73 detect the front end of the conveyed paper S.

For example, the sensors 71 and 72 detect that the paper S is conveyed to the resist roller 40. If the front end of the paper S is detected by the sensor 72, the resist roller 40 temporarily stops rotating. The front end of the paper S is aligned against the resist roller 40. If the front end of the paper S is detected by the sensor 71 and a predetermined time elapses, the resist roller 40 is rotated again. Through the rotation of the resist roller 40, the paper S is conveyed to the transfer roller 15. If the front end of the paper S is detected by the sensor 73, the conveyance roller 64 of the conveyance device 38 is rotated and then the paper S is conveyed to the downstream side.

Figure 3:
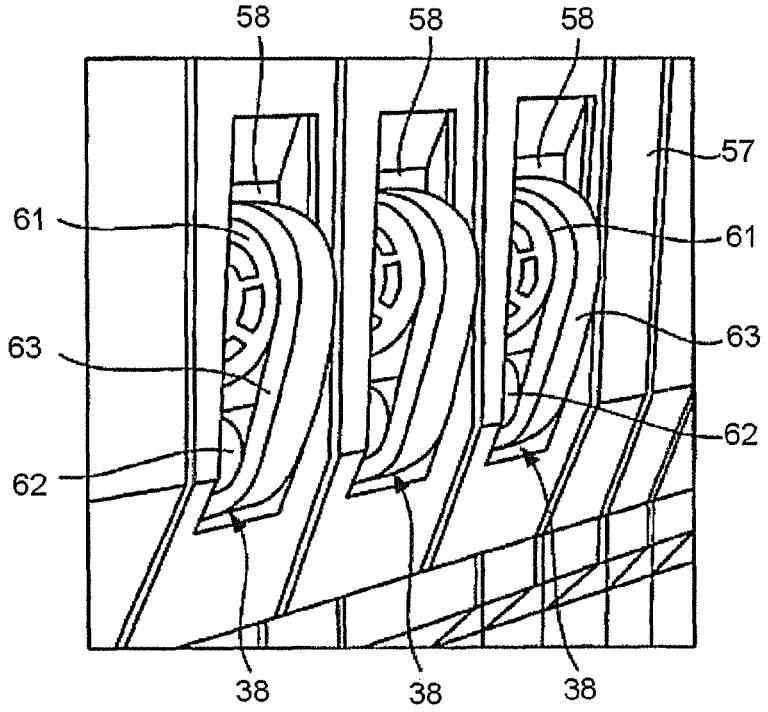
FIG. 3 is a perspective view illustrating the main portions of the paper feeding device according to the embodiment.

FIG. 3 is a perspective view illustrating the main portions of the paper feeding device 50, and shows the conveyance device 38 as a center thereof. FIG. 3 is a view of a member 57 constituting the guides 51 and 53 viewing from the outside. As shown in FIG. 3, the paper feeding device 50 has a plurality of conveyance devices 38 constituted by a pair of pulleys 61 and 62 and the belt 63 hung between the pair of pulleys 61 and 62.

Figure 4:
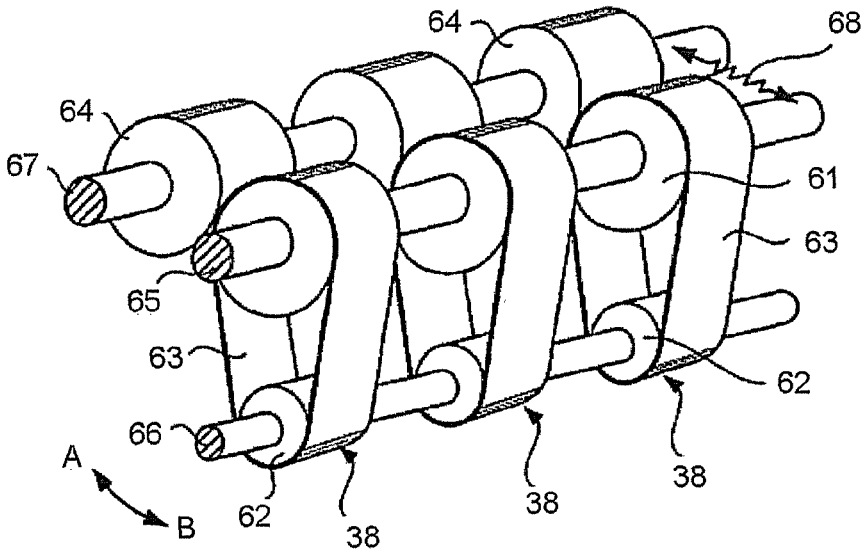
FIG. 4 is a perspective view illustrating the constitution of a conveyance device according to the embodiment.

FIG. 4 is a perspective view illustrating the constitution of the paper feeding device 38. The plurality of conveyance devices 38 (three in figure) is mounted on the axes 65 and 66. The axes 65 and 66 are inside a plurality of windows 58 formed in the member 57 of FIG. 3.

The conveyance device 38 is arranged on the axes 65 and 66 which are arranged parallelly at a predetermined distance. The pulley 61 is mounted on the axis 65 and the pulley 62 is mounted on the axis 66. The belt 63 is hung between the pulleys 61 and 62.

The conveyance roller 64 is mounted on an axis 67 arranged to be parallel with the axis 65. The axis 67 is pressed against the pulley 61 side through the spring 68. The conveyance roller 64 and the belt 63 located on the outer periphery of the pulley 61 are tightly contacted with each other, and if the conveyance roller 64 is rotated, the belt 63 is driven to rotate.

The axis 66 is rotated at a predetermined angle between the first position (left direction A of the figure) and the second position (right direction B of the figure) by taking the axis 65 as a fulcrum. A rotating mechanism 80 (FIG. 5) is arranged to rotate the axis 66. While the rotating mechanism 80 keeps the interval between the pulley 61 and the pulley 62 constant, the axis 66 of the pulley 62 is rotated by taking the axis 65 of the pulley 61 as a fulcrum.

Figure 5:
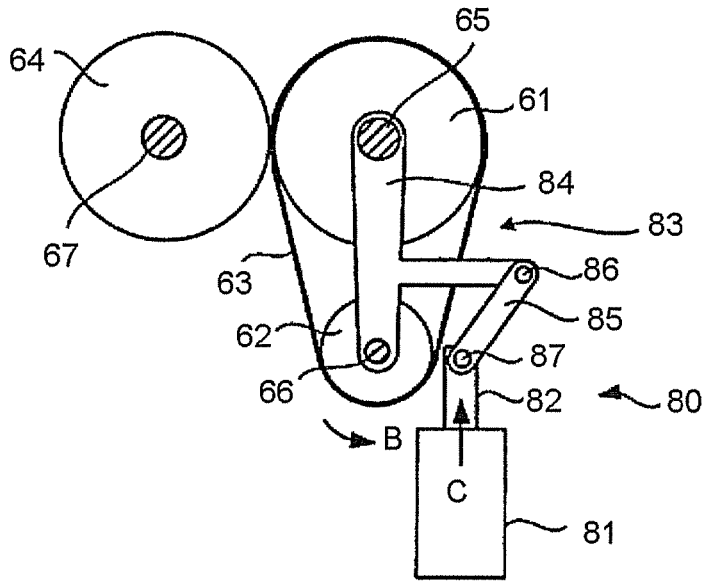
FIG. 5 is a side view illustrating a rotating mechanism of the conveyance device according to the embodiment.

FIG. 5 is a side view illustrating the rotating mechanism 80. The rotating mechanism 80 includes, for example, a solenoid 81 and a link member 83. The link member 83 has a T-shaped link arm 84 (hereinafter, referred to as a T link 84) and an I-shaped link arm 85 (hereinafter, referred to as an I link 85). One end of the T link 84 is mounted on the outer periphery of the axis 65 and the other end thereof is mounted on the outer periphery of the axis 66. Therefore, the interval between the pulley 61 and the pulley 62 is kept constant by the T link 84.

A protruding piece is formed at the intermediate part of the T link 84. The front end of the protruding piece is combined with one end of the I link 85 through a pin 86. The other end of the I link 85 is combined with a plunger 82 of the solenoid 81 through a pin 87.

In FIG. 5, the other end (axis 66 side) of the T link 84 is rotated by taking one end (axis 65 side) thereof as a fulcrum. The solenoid 81 is mounted at a fixed position. When the solenoid 81 is, for example, turned off, the plunger 82 protrudes from the main body of the solenoid 81. Further, if the solenoid 81 is turned on, the plunger 82 is drawn into the main body of the solenoid 81.

FIG. 5 shows a state in which the solenoid 81 is turned off. The plunger 82 protrudes from the main body of the solenoid 81 in a direction indicated by an arrow C. The position of pin 86 of the I link 85 moves to a right direction of figure. Therefore, the axis 66 side of the T link 84 is rotated to the second position (direction indicated by an arrow B) by taking the axis 65 side of the T link 84 as a fulcrum.

Figure 6:
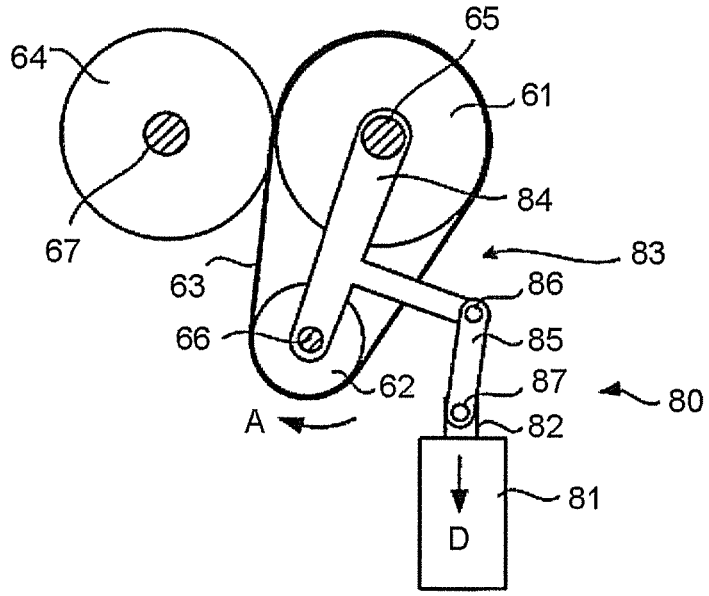
FIG. 6 is a side view illustrating the operations of the rotating mechanism according to the embodiment.

FIG. 6 shows a state in which the solenoid 81 is turned on. The plunger 82 is drawn into the main body (direction indicated by an arrow D) of the solenoid 81. Thus, the position of pin 86 of the I link 85 moves to a lower left direction of figure with respect to FIG. 5. Therefore, the axis 66 side of the T link 84 is rotated to the first position (direction indicated by an arrow A) by taking the axis 65 side of the T link 84 as a fulcrum.

Figure 7A:
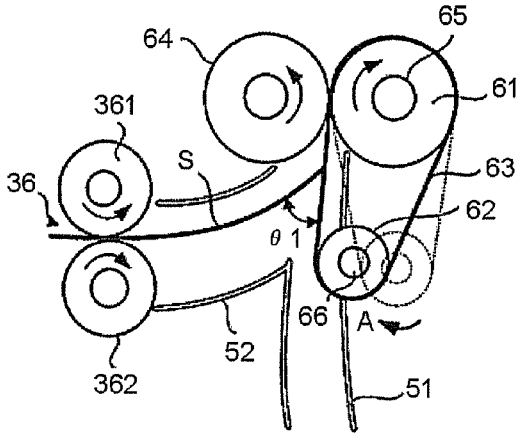
FIG. 7A~FIG. 7C are illustration diagrams illustrating the operations when a paper is conveyed in the conveyance device.
Figure 7B:
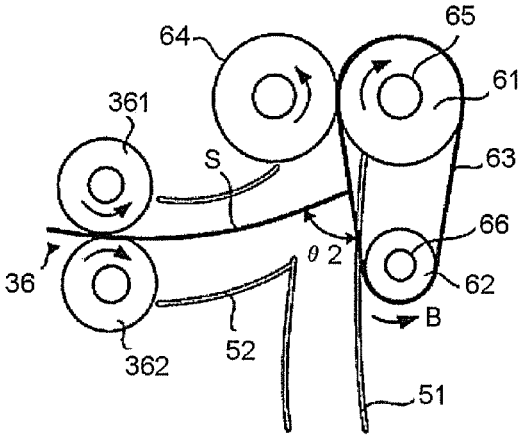
Figure 7C:
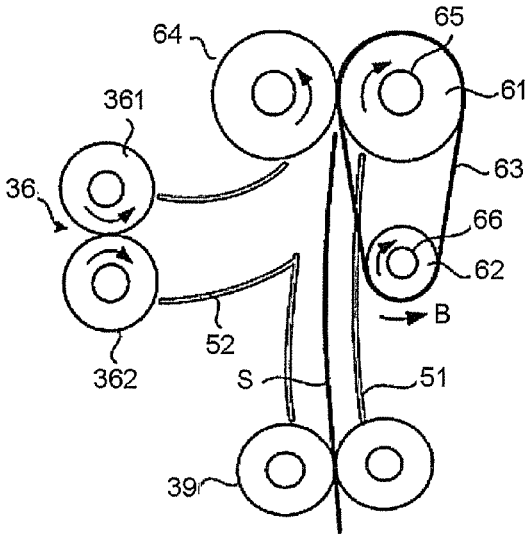

FIG. 7A-FIG. 7C are illustration diagrams illustrating the operations when the papers S from the cassettes 312 and 313 are conveyed to the conveyance device 38.

FIG. 7A and FIG. 7B show the operations when the paper S from the cassette 312 is conveyed. FIG. 7A shows a state in which the axis 66 of the pulley 62 is rotated to a first position A. A first conveyance path is formed from the paper feed roller 36 of the cassette 312 to the belt 63 of the conveyance device 38. The first conveyance path is formed through the guide 52.

When the paper S is conveyed from the paper feed roller 36 of the cassette 312 via the first conveyance path, the paper S hits the belt 63 at an acute angle θ1. At this time, the paper S hits the belt 63 and the conveyance direction of the paper S is changed towards the rotation direction of the belt 63. The angle θ1 is, for example, about 30 degrees or an angle smaller than 45 degrees. Thus, after the front end of the paper S is received at an angle smaller than 45 degrees by the belt 63, the paper S moves along the rotation direction of the belt 63 and is smoothly conveyed towards the nip part between the conveyance roller 64 and the belt 63.

FIG. 7B shows a state in which the axis 66 of the pulley 62 is rotated to a second position B. If the paper S is fed through the paper feed roller 36 when the axis 66 is rotated to the second position B, the paper S hits the belt 63 at an angle θ2 larger than 45 degrees. When the angle θ2 is large, the front end of the paper S shakes against the belt 63, the conveyance speed of paper S is slow and then the paper S is stalled.

That is, the conveyance direction of the paper S changes towards the rotation direction of the belt 63; however, even if the paper S hits the belt 63 due to the large angle θ2, the change of direction of the paper S cannot proceed smoothly, which leads to the stall. Specifically, if the paper S is the thick paper, shock when the paper hits the belt 63 becomes strong, so that the possibility of the stall becomes high. Therefore, in a case in which an image is formed on the paper S stored in the cassette 312, the axis 66 of the pulley 62 is controlled to rotate to the first position A and the paper S is conveyed to the conveyance device 38.

Further, in a case in which an image is formed on the paper stored in the lower cassette 313, the axis 66 of the pulley 62 is controlled to rotate to the second position B.

FIG. 7C is an illustration diagram illustrating the operations in a case in which the paper S is conveyed to the conveyance device 38 from the cassette 313 through the conveyance roller 39 and the guide 51. A second conveyance path is formed from the paper feed roller 37 of the cassette 313 towards the belt 63 of the conveyance device 38. The second conveyance path is formed through the guide 51.

When the paper S is conveyed from the paper feed roller 37 of the cassette 313 via the conveyance roller 39 and the second conveyance path, the axis 66 of the pulley 62 is rotated to the second position B. That is, the axis 66 of the pulley 62 is rotated to a position retracted from the second conveyance path. Thus, the paper S moves along the belt 63 and is smoothly conveyed towards the nip part between the conveyance roller 64 and the belt 63.

Furthermore, the rotation direction of the axis 66 of the pulley 62 is decided depending on the paper from which cassette selected by a user. For example, when the user stores the thick paper in the cassette 312 and selects an image formation on the thick paper on the operation panel 26, the axis 66 is rotated to the first position (A direction). When the user stores the normal paper in the cassette 313 and selects an image formation on the normal paper on the operation panel 26, the axis 66 is rotated to the second position (B direction). The rotation of the axis 66 is carried out by turning on or turning off the solenoid 81.

Of course, the normal paper may be stored in the cassette 312. In this case, if selecting the image formation on the normal paper stored in the cassette 312 through the operation panel 26, the axis 66 is rotated to the first position (A direction).

In the example described above, it is exemplified that the paper from the cassette 312 hits the belt 63 of the conveyance device 38, the direction thereof is changed and then the paper is conveyed, and the paper from the cassette 313 is smoothly conveyed along the belt 63. However, the conveyance device 38 can also be used when the paper from the cassette 311 hits the belt 63, the direction thereof is changed and then the paper is conveyed, and the paper from the cassette 312 or the cassette 313 is smoothly conveyed along the belt 63.

Specifically, apart from a case in which miniaturization is required, if there is a surplus of space, a plurality of the conveyance devices 38 may be arranged along the conveyance path 30. That is, the conveyance device 38 may be arranged at a part (merging part of the first conveyance path and the second conveyance path) merging the paper conveyed from the cassette of the upstream side and the paper conveyed from the cassette of the downstream side.

Figure 8:
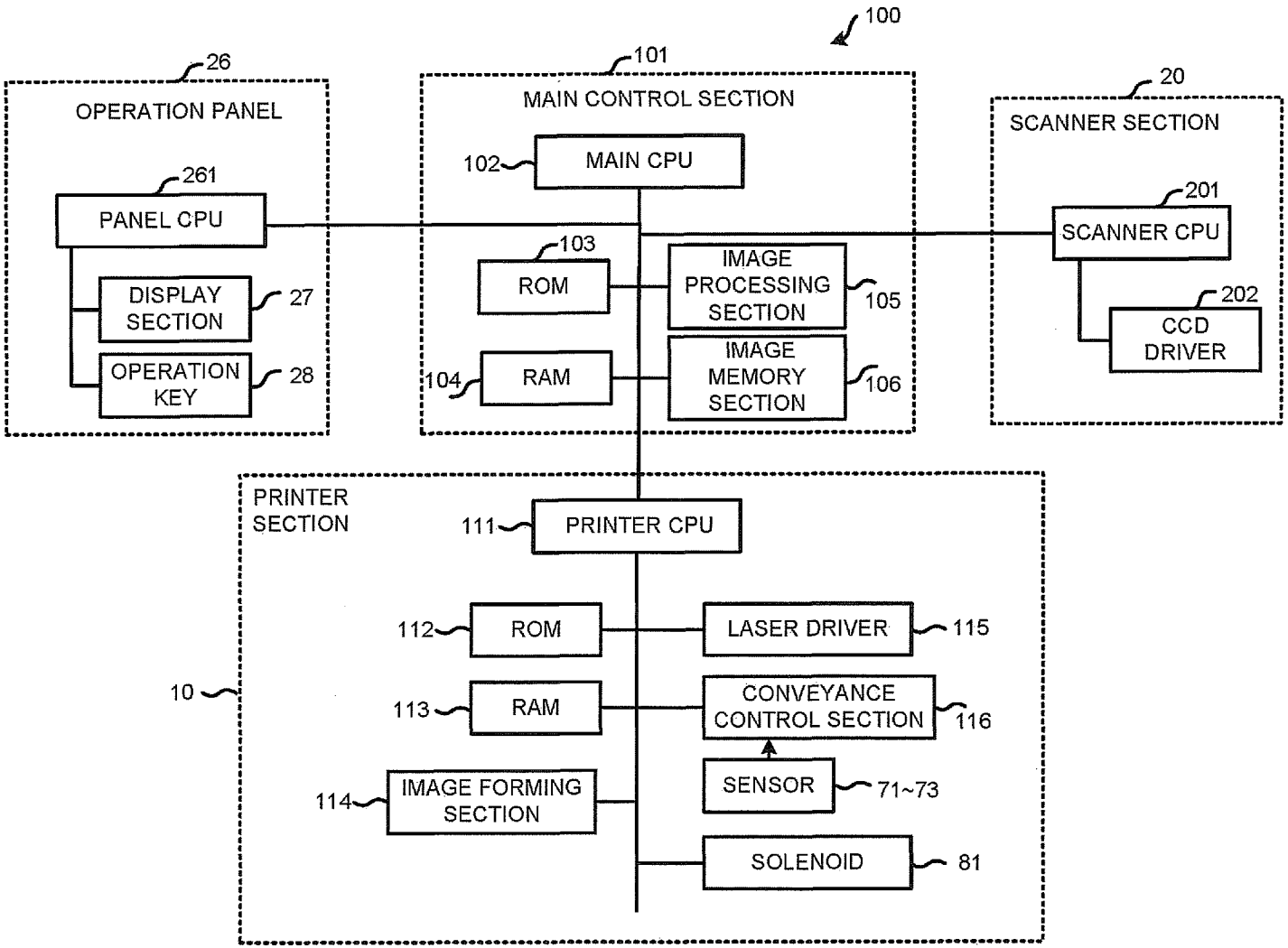
FIG. 8 is a block diagram illustrating the constitution of a control system of the image forming apparatus according to the embodiment.

FIG. 8 is a block diagram illustrating the constitution of a control system of the MFP 100 according to the embodiment. In FIG. 8, the MFP 100 has a main control section 101, the operation panel 26, the scanner section 20 and the printer section 10. The control system of the MFP 100 comprises a plurality of CPUs including a main CPU 102 in the main control section 101, a panel CPU 261 of the operation panel 26, a scanner CPU 201 of the scanner section 20 and a printer CPU 111 of the printer section 10, and carries out communication with each CPU.

The main control section 101 includes the main CPU 102, a ROM 103, a RAM 104, an image processing section 105 and an image memory section 106 such as an HDD. The main CPU 102 controls the whole operations of the MFP 100. Control programs and the liked are stored in the ROM 103. The RAM 104 temporarily stores data when the main CPU 102 carries out various kinds of processing.

The image processing section 105 processes image data read by the scanner section 20 and image data from a PC and the like. As the processing of the image data, for example, an image conversion processing such as enlargement/reduction of the image is carried out.

The image memory section 106 compresses and stores the image data read by the scanner section 20 and the image data (document data and drawing image data) from the PC. The image data stored in the image memory section 106 is input to the image processing section 105 and then various image processing is performed. The image data subjected to the image processing is printed on the paper through the printer section 10.

The operation panel 26 has the panel CPU 261 connected with the main CPU 102, the display section 27 consisting of liquid crystal and various operation keys 28. The display section 27 has a touch panel function and inputs instructions such as paper size, printing magnification, simplex printing, duplex printing, paper selection and the like. The operation key 28 includes numeric key for carrying out the instruction of printing copies and the like.

The scanner section 20 includes the scanner CPU 201 and a CCD driver 202 for driving an image sensor. The CCD driver 202 drives the image sensor to read the image of a document and converts the read image into the image data.

The printer section 10 has the printer CPU 111, a ROM 112, a RAM 113, an image forming section 114, a laser driver 115, a conveyance control section 116 and the solenoid 81. The printer section 10 carries out printing on the paper through cooperation with the main control section 101 under the control of the printer CPU 111.

In the ROM 112, programs for controlling the printer section 10 are stored. The RAM 113, which is a storage section, temporarily stores data when the printer CPU 111 carries out various kinds of processing. The printer CPU 111 controls the image forming section 114.

The image forming section 114 controls the photoconductive drum 11, the charging charger 12, the developer 14, the transfer roller 15 and the like to form the image. The image forming section 114 carries out the driving of the heat roller of the fixing device 18 and the temperature control of the heat roller. The laser driver 115 drives the laser of the exposure unit 13.

The conveyance control section 116 controls the rotation of the paper feed rollers 35, 36 and 37 and the pickup rollers 32, 33 and 34 of the paper feed cassettes to feed paper under the control of the printer CPU 111. The conveyance control section 116 controls the driving of the transfer roller 15, the conveyance roller 39, the conveyance roller 64, the resist roller 40 and the paper discharge roller 41 to convey the paper S.

The sensors 71~73 are connected with the conveyance control section 116. The sensors 71~73 detect the conveyance of the paper S passing through the conveyance path 30 and notify the conveyance, control section 116 of the detection result. The conveyance control section 116 controls the rotation of the resist roller 40 and the rotation of the conveyance roller 64 based on the detection result of the sensors 71~73.

The printer CPU 111 controls the solenoid 81 of the rotating mechanism 80 to rotate the axis 66 of the pulley 62. For example, when the cassette 312 in which the thick paper is stored is selected by the operation panel 26, the solenoid 81 is turned on and then the axis 66 is rotated to the first position A. When the cassette 313 in which the normal paper is stored is selected by the operation panel 26, the solenoid 81 is turned off and then the axis 66 is rotated to the second position B.

That is, the printer CPU 111, which constitutes the control section, rotates the axis 66 of the pulley 62 to the first position A, controls the paper S from the cassette 312 to hit the belt 63 of the conveyance device 38 and then controls to guide the paper S to the nip part. The printer CPU 111 rotates the axis 66 of the pulley 62 to the second position B and controls to guide the paper S from the cassette 313 to the nip part from the pulley 62 side of the conveyance device 38.

According to the embodiment described above, when the paper picked up from the cassette hits the belt 63 of the conveyance device 38 and then the conveyance direction thereof changes, the paper enters at an angle smaller than 45 degrees with respect to the belt 63. Thus, the possibility that the paper is stalled and cannot be conveyed is reduced. Because of smooth conveyance of the paper, the possibility that the damages are applied to the paper is also reduced. Without increasing the machine body height or the machine body width of the image forming apparatus, it is possible to reduce the angel of approach to the belt of the conveyance device and realize the miniaturization.

Further, it is not limited to the embodiment described above, various applications are possible. For example, the present embodiment can also be applied to an image forming apparatus which has a plurality of developing units for color like a 4-tandem type. The exposure unit 13 can be replaced by a scanning head including LED elements. Moreover, the rotating mechanism 80 for rotating the axis 66 of the pulley 62 is not limited to the example illustrated and can use the other mechanism.

It is exemplified that the conveyance control section 116 of the printer section 10 controls the conveyance of the paper under the control of the printer CPU 111, but the conveyance control section 116 of the printer section 10 may control the conveyance of the paper through a single control section (for example, the main CPU 102). The ROM 112 and the RAM 113 can be replaced by the ROM 103 and the RAM 104 of the main control section 101.

Further, three conveyance devices 38 are arranged on the axis 65 and 66 in FIG. 3 and FIG. 4. However, the conveyance device 38 is not limited to three. That is, through changing the width of the belt 63, the conveyance device 38 can also be constituted with other numbers such as two, four and the like. The conveyance roller 64, which is similar to the conveyance device 38, may be arranged to match with the number of the conveyance device 38.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a paper feed cassette configured to include a first cassette and a second cassette for storing a recording medium;

an operation section configured to select one cassette within the paper feed cassettes;

a conveyance device configured to include a rotatable first pulley and a rotatable second pulley arranged side by side, a belt hung on the first pulley and the second pulley and a conveyance roller connected with the belt on the outer periphery of the first pulley and rotating together with the belt, and sandwich and convey the recording medium at a nip part between the conveyance roller and the belt;

a rotating mechanism configured to rotate the axis of the second pulley by taking the axis of the first pulley of the conveyance device as a fulcrum;

a control section configured to control the rotating mechanism so as to rotate the axis of the second pulley to a first position when the first cassette is selected by the operation section, make a recording medium from the first cassette hit the belt of the conveyance device and then guide the recording medium to the nip part, or rotate the axis of the second pulley to a second position when the second cassette is selected by the operation section and then guide a recording medium from the second cassette from the second pulley side of the conveyance device to the nip part; and an image forming section configured to form an image on the recording medium conveyed by the conveyance device.

2. The image forming apparatus according to claim 1, wherein the conveyance device, when rotating the second pulley to the first position, after receiving the recording medium from the first cassette at an angle smaller than 45 degrees, conveys the recording medium to the direction of the nip part, and when rotating the second pulley to the second position, conveys the recording medium from the second cassette to the direction of the nip part along the belt.

3. The image forming apparatus according to claim 1, further comprising:

a first conveyance path configured to convey the recording medium of the first cassette to the belt of the conveyance device; and a second conveyance path configured to convey the recording medium of the second cassette to the nip part from the second pulley side of the conveyance device, wherein the conveyance device is arranged at a position where the first conveyance path and the second conveyance path are merged.

4. The image forming apparatus according to claim 3, wherein the rotating mechanism rotates the axis of the second pulley between the first position closer to the first conveyance path and the second position of which the direction is opposite to the first position retracted from the second conveyance path by taking the axis of the first pulley of the conveyance device as a fulcrum.

5. The image forming apparatus according to claim 1, further comprising:

a resist roller configured to align the recording medium passing through the nip part of the conveyance device before conveying the recording medium to the image informing section.

6. The image forming apparatus according to claim 1, wherein thick papers are stored in the first cassette within the paper feed cassettes; and the control section, when the first cassette is selected by the operation section, controls the rotating mechanism to rotate the axis of the second pulley to the first position.

7. The image forming apparatus according to claim 1, wherein the first pulley and the second pulley are rotatably mounted respectively on a first axis and a second axis arranged side by side; and the rotating mechanism, while keeping the interval between the first pulley and the second pulley constant, rotates the second axis by taking the first axis as a fulcrum.

8. The image forming apparatus according to claim 1, wherein the rotating mechanism is equipped with a link member mounted between the first axis and the second axis and a solenoid rotating the second axis side of the link member between the first position and the second position.

9. The image forming apparatus according to claim 8, wherein the control section, depending on when the recording medium is conveyed from the first cassette and when the recording medium is conveyed from the second cassette, controls to turn on or off the solenoid.

10. An image forming apparatus, comprising:

a paper feed cassette configured to include a first cassette and a second cassette for storing a recording medium;

a conveyance device configured to include a rotatable first pulley and a rotatable second pulley arranged side by side, a belt hung on the first pulley and the second pulley and a conveyance roller connected with the belt on the outer periphery of the first pulley and rotating together with the belt, and sandwich and convey the recording medium at a nip part between the conveyance roller and the belt;

a rotating mechanism configured to rotate the axis of the second pulley by taking the axis of the first pulley of the conveyance device as a fulcrum;

a control section configured to control a turning on or off of the rotating mechanism depending on when the recording medium is conveyed from the first cassette and when the recording medium is conveyed from the second cassette, so as to rotate the axis of the second pulley to a first position, make a recording medium from the first cassette hit the belt of the conveyance device and then guide the recording medium to the nip part, or rotate the axis of the second pulley to a second position and then guide a recording medium from the second cassette from the second pulley side of the conveyance device to the nip part; and an image forming section configured to form an image on the recording medium conveyed by the conveyance device.

11. The image forming apparatus according to claim 10, wherein the conveyance device, when rotating the second pulley to the first position, after receiving the recording medium from the first cassette at an angle smaller than 45 degrees, conveys the recording medium to the direction of the nip part, and when rotating the second pulley to the second position, conveys the recording medium from the second cassette to the direction of the nip part along the belt.

12. The image forming apparatus according to claim 10, further comprising:

a first conveyance path configured to convey the recording medium of the first cassette to the belt of the conveyance device; and a second conveyance path configured to convey the recording medium of the second cassette to the nip part from the second pulley side of the conveyance device, wherein the conveyance device is arranged at a position where the first conveyance path and the second conveyance path are merged.

13. The image forming apparatus according to claim 12, wherein the rotating mechanism rotates the axis of the second pulley between the first position closer to the first conveyance path and the second position of which the direction is opposite to the first position retracted from the second conveyance path by taking the axis of the first pulley of the conveyance device as a fulcrum.

14. The image forming apparatus according to claim 10, further comprising:

a resist roller configured to align the recording medium passing through the nip part of the conveyance device before conveying the recording medium to the image informing section.

15. The image forming apparatus according to claim 10, further comprising:

an operation section configured to select one cassette within the paper feed cassettes, wherein the control section, when the first cassette is selected by the operation section, controls the rotating mechanism to rotate the axis of the second pulley to the first position and when the second cassette is selected by the operation section, controls the rotating mechanism to rotate the axis of the second pulley to the second position.

16. The image forming apparatus according to claim 15, wherein thick papers are stored in the first cassette within the paper feed cassettes; and the control section, when the first cassette is selected by the operation section, controls the rotating mechanism to rotate the axis of the second pulley to the first position.

17. The image forming apparatus according to claim 10, wherein the first pulley and the second pulley are rotatably mounted respectively on a first axis and a second axis arranged side by side; and the rotating mechanism, while keeping the interval between the first pulley and the second pulley constant, rotates the second axis by taking the first axis as a fulcrum.

18. The image forming apparatus according to claim 10, wherein the rotating mechanism is equipped with a link member mounted between the first axis and the second axis and a solenoid rotating the second axis side of the link member between the first position and the second position.

* * * * *